US009530542B2

(12) United States Patent
Akimoto et al.

(10) Patent No.: US 9,530,542 B2
(45) Date of Patent: Dec. 27, 2016

(54) SHIELDED CABLE

(71) Applicant: Hitachi Metals, Ltd., Tokyo (JP)

(72) Inventors: Katsuya Akimoto, Hitachi (JP); Naofumi Chiwata, Mito (JP); Yosuke Sumi, Hitachinaka (JP); Katsutoshi Nakatani, Hitachi (JP); Kenji Ajima, Hitachiota (JP); Hiroshi Okikawa, Hitachi (JP); Yasuharu Muto, Kitaibaraki (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 14/618,793

(22) Filed: Feb. 10, 2015

(65) Prior Publication Data

US 2015/0228377 A1 Aug. 13, 2015

(30) Foreign Application Priority Data

Feb. 12, 2014 (JP) ..... 2014-024311

(51) Int. Cl.
*H01B 11/06* (2006.01)
*H01B 11/10* (2006.01)
*H01B 3/30* (2006.01)

(52) U.S. Cl.
CPC ..... *H01B 11/1083* (2013.01); *H01B 3/30* (2013.01); *H01B 11/1008* (2013.01)

(58) Field of Classification Search
CPC ..... H01B 11/1083; H01B 11/1091
USPC ..... 174/36, 126.2
See application file for complete search history.

(56) References Cited

U.S. PATENT DOCUMENTS

| | | | | |
|---|---|---|---|---|
| 1,809,042 A * | 6/1931 | Kelsall | H01F 1/20 | 148/104 |
| 3,643,007 A * | 2/1972 | Roberts | H01B 11/1808 | 174/106 R |
| 5,637,260 A * | 6/1997 | Okuda | B82Y 30/00 | 174/125.1 |
| 6,225,565 B1 * | 5/2001 | Prysner | H01B 9/027 | 174/120 SC |
| 2002/0014349 A1 * | 2/2002 | Dewdney | H02G 1/14 | 174/74 A |
| 2003/0030529 A1 * | 2/2003 | Min | H01F 3/14 | 336/182 |

FOREIGN PATENT DOCUMENTS

| | | | |
|---|---|---|---|
| JP | 06-117711 | * | 4/1994 |
| JP | 2007-059150 A | | 3/2007 |
| JP | 5019730 B2 | | 9/2012 |

* cited by examiner

*Primary Examiner* — Chau N Nguyen
(74) *Attorney, Agent, or Firm* — McGinn IP Law Group, PPLC.

(57) ABSTRACT

A shielded cable includes an insulated wire including a conductor wire and an insulation formed around the conductor wire, and a shield layer formed around the insulated wire and including a shield wire. The shield wire includes a tubular member including a conductive material and defining a gap therein, and a magnetic powder is filled in the gap.

5 Claims, 3 Drawing Sheets

SHIELDED CABLE

The present application is based on Japanese patent application No. 2014-024311 filed on Feb. 12, 2014, the entire contents of which are incorporated herein by reference.

BACKGROUND OF THE INVENTION

1. Field of the Invention

The invention relates to a shielded cable.

2. Description of the Related Art

In general, wires for sensors or electrical components use a shield layer formed around an insulation layer of a conductive wire so as to prevent the introduction or emission of electromagnetic noise. The shield layer is generally formed by being braided or served so as to facilitate the bending.

A shielded cable has been proposed in which a shield layer is formed of a composite strand having a two-layer structure that is composed of a layer of a magnetic material and a layer of a conductive material to absorb the electric and magnetic fields of electromagnetic noise (see e.g. JP-B-5019730).

The shielded cable has a shield layer formed by braiding composite strands each composed of an inner layer of copper and an outer layer of iron as a magnetic material provided on the outer side of the inner layer. In this configuration, the layer formed of a magnetic material exerts a shielding effect against radio wave in a low-frequency band and the layer formed of a conductive material exerts a shielding effect against radio wave in a high-frequency band.

SUMMARY OF THE INVENTION

In the conventional shielded cable, since the different metals are attached to each other in the composite strand (shield wire), an unwanted metal compound or electrical corrosion may occur at the interface therebetween so as to lower the strength of the composite strand. In addition, since there is a difference in linear expansion coefficient between the different metals, the composite strand may be broken due to the heat cycle.

It is an object of the invention to provide a shielded cable that prevents the shield wires from being broken while shielding the noise in a wide frequency band.

(1) According to one embodiment of the invention, a shielded cable comprises:

an insulated wire comprising a conductor wire and an insulation formed around the conductor wire; and a shield layer formed around the insulated wire and comprising a shield wire, wherein the shield wire comprises a tubular member comprising a conductive material and defining a gap therein, and a magnetic powder filled in the gap.

In the above embodiment (1) of the invention, the following modifications and changes can be made.

(i) The gap comprises a plurality of gaps defined in the tubular member, and wherein the magnetic powder is filled in each of the plurality of gaps.

(ii) The shield layer comprises braided shield wires.

(iii) The shield layer comprises wound shield wires around the insulated wire.

Advantageous Effects of the Invention

According to the invention, a shielded cable can be provided that prevents the shield wires from being broken while shielding the noise in a wide frequency band.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Figure 1:
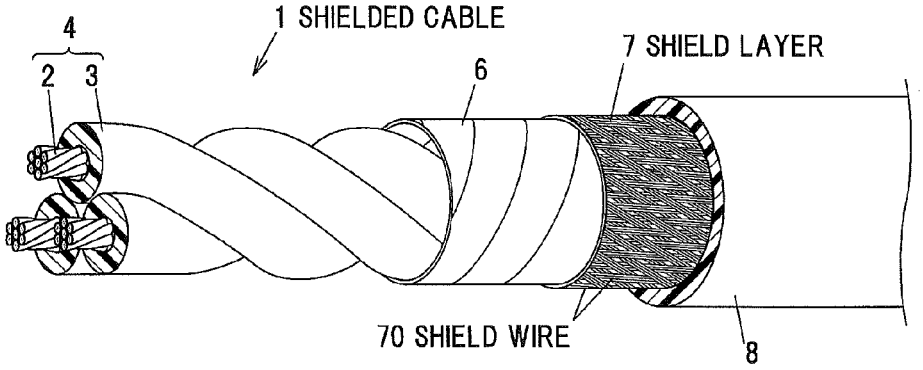
FIG. 1 is a perspective view showing a general configuration of a shielded cable in a first embodiment of the present invention.

Embodiments of the invention will be described below in reference to the drawings. It should be noted that constituent elements having substantially the same functions are denoted by the same reference numerals in each drawing and the overlapping explanation thereof will be omitted.

First Embodiment

Figure 2:
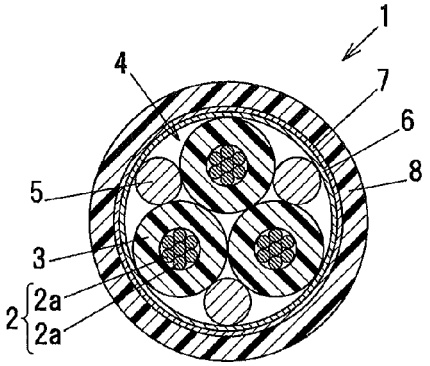
FIG. 2 is a cross sectional view showing the shielded cable shown in FIG. 1.

FIG. 1 is a perspective view showing a general configuration of a shielded cable in the first embodiment of the invention. FIG. 2 is a cross sectional view showing the shielded cable shown in FIG. 1. The illustration of inclusions 5 is omitted in FIG. 1.

A shielded cable 1 is provided with plural insulated wires 4 (three in the first embodiment) each formed by covering a conductor wire 2 with an insulation 3, a resin tape layer 6 wound around the plural insulated wires 4 with inclusions 5 interposed therebetween, a shield layer 7 provided around the resin tape layer 6, and a sheath 8 as an insulating protective layer formed of a resin, etc., and provided around the shield layer 7.

The conductor wire 2 is formed by twisting plural thin metal wires 2*a* (seven in the first embodiment) together. The insulated wire 4 transmits a signal of, e.g., 1 MHz to 10 GHz. The conductor wire 2 may alternatively be a solid wire. In addition, the number of the insulated wires 4 is more than one in the first embodiment but may be one. In addition, the insulated wire 4 may be a twisted wire pair which transmits differential signals.

The resin tape layer 6 is formed by, e.g., winding a resin tape around the plural insulated wires 4 with the inclusions 5 interposed therebetween throughout a longitudinal direction of the cable. As the rein tape, it is possible to use, e.g., a tape formed of a resin such as polyethylene terephthalate (PET) or polypropylene-based resin, etc.

The shield layer 7 is formed by, e.g., braiding shield wires 70 and is connected to a ground. The sheath 8 is formed of, e.g., a vinyl chloride resin, an ethylene vinyl acetate polymer, a fluorine-based resin or a silicone-based resin, etc.

Configuration of Shield layer

Figure 3:
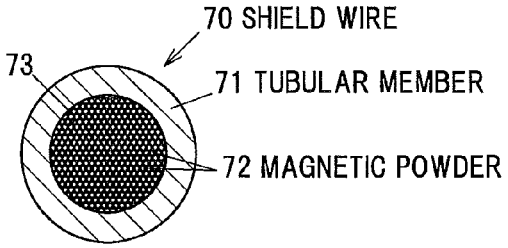
FIG. 3 is a cross sectional view showing a shield wire constituting a shield layer in the first embodiment.

FIG. 3 is a cross sectional view showing the shield wire 70 constituting the shield layer 7. The shield wire 70 is provided with a tubular member 71 formed of a conductive material and having a circular cross-sectional shape, and a magnetic powder 72 filled in an inner space (or gap or through hole extending in the longitudinal direction of shield wire) 73 of the tubular member 71. Here, tin plating may be applied to a surface of the tubular member 71 of the shield wire 70.

As the conductive material constituting the tubular member 71, it is possible to use, e.g., copper, copper alloy, aluminum and aluminum alloy, etc. The outer diameter of the tubular member 71 is exemplarily 0.5 to 1 mm. The tubular member 71 may alternatively have a flat shape.

The magnetic powder 72 is exemplarily formed of a soft magnetic material with a small coercive force and high magnetic permeability in order to suppress electromagnetic wave noise. As the soft magnetic material, it is possible to use, e.g., ferrite powder such as Mn—Zn ferrite powder, Ni—Zn ferrite powder or Ni—Zn—Cu ferrite powder, and soft magnetic metal powder such as Fe—Ni alloy (permalloy), Fe—Si—Al alloy (sendust) or Fe—Si alloy (silicon steel). Of these soft magnetic materials, ferrite powder is exemplary since chemical reaction with a conductive material constituting the tubular member 71 is less likely to occur. The size of the magnetic powder 72 is exemplarily not less than 1 μm and not more than 100 μm.

For manufacturing the shield wire 70 configured as described above, the magnetic powder 72 is filled in a pipe of conductive material as the tubular member 71 and wire drawing is performed for several times while annealing in the middle of process.

Functions and Effects of the First Embodiment

The following functions and effects are obtained in the first embodiment.

(1) The magnetic powder 72 constituting the shield wire 70 shields mainly electromagnetic wave noise in a low-frequency band by absorbing a magnetic field of electromagnetic wave noise generated by the insulated wires 4. Meanwhile, the tubular member 71 formed of a conductive material and constituting the shield wire 70 shields mainly electromagnetic wave noise in a high-frequency band by absorbing an electric field of electromagnetic wave noise generated by the insulated wires 4. Therefore, it is possible to provide a highly reliable shielded cable which is suitable for shielding noise in a wide frequency band.

(2) Some space is present between particles of the magnetic powder 72 filled in the inner space 73. Therefore, even if there is a difference in linear expansion coefficient between the magnetic powder 72 and the tubular member 71, the shield wire 70 is less likely to be damaged and electrical corrosion hardly occurs. It is thus possible to suppress breakage of the shield wire 70 even when subjected to heat cycle.

(3) The shield layer 7 formed of the shield wires 70 allows a shielded cable excellent in bending properties to be provided.

Second Embodiment

Figure 4:
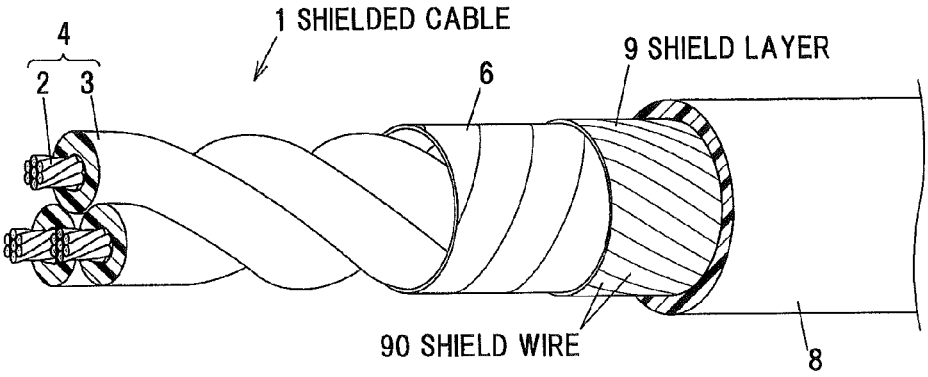
FIG. 4 is a perspective view showing a general configuration of a shielded cable in a second embodiment of the invention.
Figure 5:
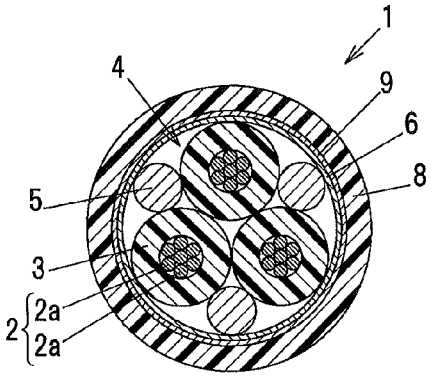
FIG. 5 is a cross sectional view showing the shielded cable shown in FIG. 4.

FIG. 4 is a perspective view showing a general configuration of a shielded cable in the second embodiment of the invention. FIG. 5 is a cross sectional view showing the shielded cable shown in FIG. 4. The illustration of the inclusions 5 is omitted in FIG. 4.

In contrast to the first embodiment in which the shield wires 70 constituting the shield layer 7 are each formed using the tubular member 71 having one inner space 73 and are braided, shield wires 90 constituting a shield layer 9 in the second embodiment are each formed using a flat tubular member 91 having plural (seven in the second embodiment) inner spaces 93 and are spirally wound (spiral shield) around the resin tape layer 6.

Configuration of Shield layer

Figure 6:
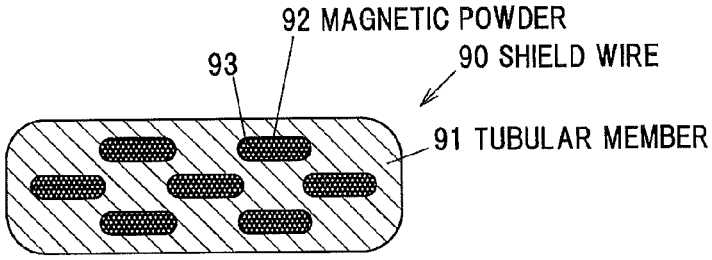
FIG. 6 is a cross sectional view showing a shield wire constituting a shield layer in the second embodiment.

FIG. 6 is a cross sectional view showing the shield wire 90 constituting the shield layer 9. The shield wire 90 is provided with a tubular member 91 formed of a conductive material and having plural inner spaces (or gaps or through holes extending in the longitudinal direction of shield wire) 93, and a magnetic powder 92 filled in the inner spaces 93 of the tubular member 91. Here, tin plating may be applied to a surface of the tubular member 91 of the shield wire 90.

For the conductive material constituting the tubular member 91, it is possible to use the same material as the tubular member 71 in the first embodiment. The outer size of the tubular member 91 is exemplarily 0.2 to 2 mm in thickness and 1 to 20 mm in width.

As the magnetic powder 92, it is possible to use the same material as the magnetic powder 72 in the first embodiment.

Figure 7A:
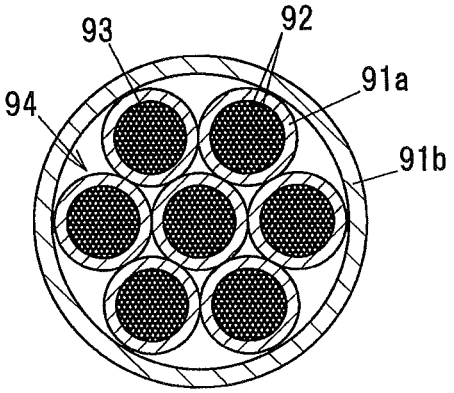
FIGS. 7A to 7C are diagrams illustrating an example of a manufacturing process of the shield wire in the second embodiment.
Figure 7B:
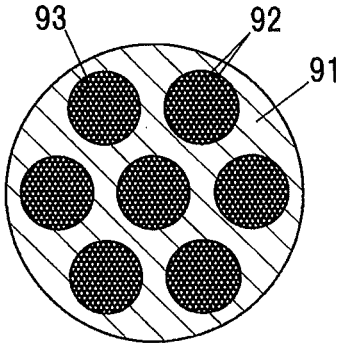
Figure 7C:
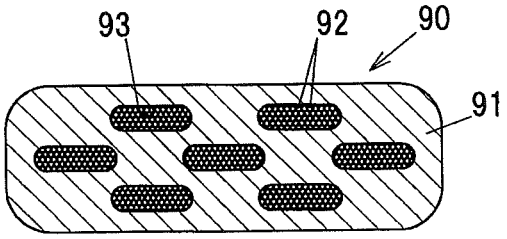

FIGS. 7A to 7C are cross sectional views roughly showing an example of a manufacturing process of the shield wire 90. Firstly, as shown in FIG. 7A, the magnetic powder 92 is filled in the inner spaces 93 of plural pipes 91*a* formed of a conductive material as a part of the tubular member 91, and the plural pipes 91*a* filled with the magnetic powder 92 are arranged in a large-bore pipe 91*b* formed of a conductive material. Next, wire drawing is performed for several times while annealing in the middle of process, thereby making a shield wire shown in FIG. 7B. Then, the shield wire shown in FIG. 7B is drawn for several times while annealing in the middle of process, thereby making the shield wire 90 shown in FIG. 7C.

Functions and Effects of the Second Embodiment

The following functions and effects are obtained in the second embodiment.

(1) The magnetic powder 92 constituting the shield wire 90 shields electromagnetic wave noise in a low-frequency band by absorbing a magnetic field of electromagnetic wave noise generated by the insulated wires 4. Meanwhile, the tubular member 91 formed of a conductive material and constituting the shield wire 90 shields electromagnetic wave noise in a high-frequency band by absorbing an electric field of electromagnetic wave noise generated by the insulated wires 4. Therefore, it is possible to provide a highly reliable shielded cable which is suitable for shielding noise in a wide frequency band.

(2) Some space is present between particles of the magnetic powder 92 filled in the inner spaces 93. Therefore, even if there is a difference in linear expansion coefficient between the magnetic powder 92 and the tubular member 91, the shield wire 90 is less likely to be damaged and electrical corrosion hardly occurs. It is thus possible to suppress breakage of the shield wire 90 even when subjected to heat cycle.

(3) The shield layer 9 formed of the shield wires 90 allows a shielded cable excellent in bending properties to be provided.

It should be noted that embodiments of the invention are not limited to those described above and various kinds of embodiments can be implemented. The shield wires 70 in the first embodiment may be spirally wound. In addition, the shield wires 90 in the second embodiment may be braided.

In addition, some of the constituent elements in the embodiments can be omitted or changed without changing the gist of the invention. For example, the inclusion 5 may be omitted as long as no problem arises when winding a resin tape around the plural insulated wires 4.

What is claimed is:

1. A shielded cable, comprising: an insulated wire comprising a conductor wire and an insulation formed around the conductor wire; and a shield layer formed around the insulated wire and comprising a shield wire, wherein the shield wire comprises a tubular member comprising a conductive material including inner spaces, and a magnetic powder filled in each of the inner spaces of the tubular member, wherein voids are present between particles of the magnetic powder, wherein each of the inner spaces has a flat shape.

2. The shielded cable according to claim 1, wherein the tubular member has a flat shape.

3. The shielded cable according to claim 1, wherein the voids between the particles of the magnetic powder are configured to provide a space to compensate for a difference between linear expansion coefficients of the magnetic powder and the tubular member.

4. The shielded cable according to claim 1, further comprising:

a resin tape layer wound around the plurality of insulated wires with inclusions interposed therebetween; and a sheath provided around the shield layer, wherein the shield layer is provided around the resin tape layer.

5. The shielded cable according to claim 1, wherein the conductor wire comprises a plurality of metal wires twisted together.

* * * * *